US009213264B2

(12) United States Patent
Nakayama et al.

(10) Patent No.: US 9,213,264 B2
(45) Date of Patent: Dec. 15, 2015

(54) IMAGE FORMING DEVICE

(71) Applicant: Konica Minolta, Inc., Tokyo (JP)

(72) Inventors: Yasunori Nakayama, Toyokawa (JP); Shinji Ogawa, Toyokawa (JP); Toshiya Aoki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/314,651

(22) Filed: Jun. 25, 2014

(65) Prior Publication Data

US 2015/0010315 A1 Jan. 8, 2015

(30) Foreign Application Priority Data

Jul. 3, 2013 (JP) ..... 2013-139381

(51) Int. Cl.
*G03G 15/08* (2006.01)

(52) U.S. Cl.
CPC ..... *G03G 15/0879* (2013.01); *G03G 15/0849* (2013.01); *G03G 15/0893* (2013.01)

(58) Field of Classification Search
CPC ... G03G 9/0819; G03G 15/0879; G03G 9/10; G03G 15/0849
USPC ..... 399/30, 53, 253, 259
See application file for complete search history.

(56) References Cited

U.S. PATENT DOCUMENTS

| | | | | |
|---|---|---|---|---|
| 2004/0067069 | A1* | 4/2004 | Ogata | 399/27 |
| 2005/0063714 | A1* | 3/2005 | Kinoshita et al. | 399/27 |
| 2005/0063716 | A1* | 3/2005 | Fujiwara | 399/27 |
| 2006/0127109 | A1* | 6/2006 | Itoyama et al. | 399/27 |
| 2007/0065164 | A1* | 3/2007 | Fujimori et al. | 399/27 |
| 2009/0080913 | A1* | 3/2009 | Suzuki | 399/30 |
| 2009/0214232 | A1* | 8/2009 | Murauchi et al. | 399/30 |
| 2009/0245879 | A1* | 10/2009 | Minami et al. | 399/255 |
| 2014/0205327 | A1* | 7/2014 | Nakamura et al. | 399/258 |

FOREIGN PATENT DOCUMENTS

JP 2007-052213 A 3/2007

* cited by examiner

*Primary Examiner* — Francis Gray
(74) *Attorney, Agent, or Firm* — Lucas & Mercanti, LLP

(57) ABSTRACT

An image forming device includes: a developing device which includes a developing unit storing a developer containing a first carrier and a toner and a toner concentration detection unit detecting a toner concentration within the developing unit; and a supply container which stores a supply developer containing a second carrier and the toner, and supplies, based on a detection value by the toner concentration detection unit, the supply developer to the developing unit and discharges an excessive amount of the developer within the developing unit from the developing unit. Then, the setting value of the toner concentration detection unit is corrected based on the presence proportion of the second carrier within the developing unit detected by a calculation unit.

7 Claims, 5 Drawing Sheets

IMAGE FORMING DEVICE

This application is based on Japanese Patent Application No. 2013-139381 filed on Jul. 3, 2013 the contents of which are hereby incorporated by reference.

BACKGROUND OF THE INVENTION

1. Field of the Invention

The present invention relates to an image forming device, and more particularly relates to an image forming device that includes a developing device of a so-called trickle system which supplies a new developer while discharging a degraded developer little by little.

2. Description of the Related Art

In a developing unit using a two-component developer containing a toner and a carrier, since the toner is consumed by image formation but the carrier remains within the developing unit, the carrier is degraded with time. Hence, in recent years, much attention has been focused on the so-called trickle system which supplies a new developer to the developing unit while discarding, little by little, the developer containing the carrier from the developing unit, and various proposals have been made.

For example, in Japanese Unexamined Patent Publication No. 2007-52213, in order to reduce variations in the properties of a developer caused by the difference between a print mode and a print coverage, a technology is proposed in which a control voltage of a toner concentration detection unit is corrected based on a developing member operating time and the amount of carrier supplied.

Incidentally, the weight of the developer supply bottle of the trickle system is increased by a weight corresponding to the carrier contained therewithin, as compared with a supply bottle that supplies only a toner. Normally, the weight proportion of the carrier in the developer supply bottle of the trickle system is 10% to 20%, and since the amount of carbon dioxide discharged is increased accordingly, a load to the environment is increased. Hence, studies have been conducted where in order to reduce the load to the environment, as the carrier within the developer supply bottle, a carrier whose bulk density is less than that of the carrier within the developing unit is used.

However, a toner concentration within the developing unit is detected with, for example, a detection unit such as a permeability sensor, and based on its detection value, the supply of the developer from a supply container is controlled such that the toner concentration is kept within a predetermined range, but when the physical property of the carrier supplied to the developing unit is different from that of the carrier within the developing unit, a correlation between the actual toner concentration within the developing unit and the detection value of the permeability sensor is degraded, with the result that even if the detection value of the permeability sensor remains the same, the actual toner concentration within the developing unit may be varied. When the toner concentration within the developing unit is varied, a toner charge amount is varied, and thus a failure such as a reduction in image concentration, fogging, uneven density or scattered toner may be produced.

SUMMARY OF THE INVENTION

In view of the foregoing conventional problem, the present invention is made, and an object of the present invention is to provide a developing device that can keep a toner concentration in a developing unit within a predetermined range even when a carrier whose bulk density is different from that of a carrier within the developing unit is supplied to the developing unit.

Another object of the present invention is to provide an image forming device in which a failure such as a reduction in image concentration, fogging, uneven density or scattered toner does not occur.

According to the present invention, there is provided an image forming device that includes: a developing device which includes a developing unit storing a developer containing a first carrier and a toner and a toner concentration detection unit detecting a toner concentration within the developing unit; and a supply container which stores a supply developer containing a second carrier whose bulk density is different from a bulk density of the first carrier and the toner, to which a recording member recording a property of the second carrier is attached and which is removable with respect to a device main body, and that supplies, based on a detection value by the toner concentration detection unit, the supply developer from the supply container to the developing unit and discharges an excessive amount of the developer within the developing unit from the developing unit, the image forming device further including: a first storage unit which stores a storage amount of the first carrier stored in the developing unit before feeding of the second carrier and a property of the first carrier; a reading unit which reads the property of the second carrier from the recording member; a second storage unit which stores the property of the second carrier read by the reading unit and a supply amount of the second carrier supplied from the supply container to the developing unit; and a calculation unit which calculates a presence proportion of the second carrier within the developing unit from the storage amount of the first carrier stored in the developing unit before feeding of the second carrier and the supply amount of the second carrier supplied from the supply container to the developing unit, where a setting value of the toner concentration detection unit is corrected based on the presence proportion of the second carrier detected by the calculation unit.

Here, when at least one of an A carrier and a B carrier is supplied as the second carrier into the developing unit in which the A carrier and the B carrier are stored as the first carrier in predetermined proportions, a presence proportion $R_{NEW}$ of the B carrier within the developing unit is calculated from formulas (1) to (3) below:

(i) When $M_{C0}+M_{CA}+M_{CB}:\leq M_F$, $R_{NEW}=M_{CB}/(M_{C0}+M_{CA}+M_{CB})$ (1)

(ii) When $M_{C0}+M_{CA}+M_{CB}:>M_F$ and the $A$ carrier is supplied, $R_{NEW}=(M_{FB}\times R_d)/(M_f+M_{C1})$ (2)

(iii) When $M_{C0}+M_{CA}+M_{CB}:>M_F$ and the $B$ carrier is supplied, $R_{NEW}=(M_{FB}\times R_d+M_{C1})/(M_f+M_{C1})$ (3)

where $M_F$: carrier discharge start weight $(M_{FA}\times(1-R_d)+M_{FB}\times R_d)$ $M_{C0}$: carrier weight at time of start, $M_{FA}$: discharge start carrier weight with only the A carrier, $M_{FB}$: discharge start carrier weight with only the B carrier, $R_d$: proportion of the B carrier within the developing unit before supply of the developer, $M_{CA}$: accumulated supply amount of the A carrier, $M_{CB}$: accumulated supply amount of the B carrier and $M_{C1}$: carrier weight within the developer supplied.

The bulk density of the second carrier is preferably 0.6 to 0.95 times the bulk density of the first carrier.

The setting value of the toner concentration detection unit may be further corrected based on at least one piece of information of a number of sheets of images formed, an operating environment and an image print coverage.

The properties of the first carrier and the second carrier are a correlation between the detection value of the toner concentration detection unit and the toner concentration.

DESCRIPTION OF PREFERRED EMBODIMENTS

Although an image forming device according to the present invention will be described in further detail with reference to accompanying drawings, the present invention is not limited to such an embodiment.

Figure 1:
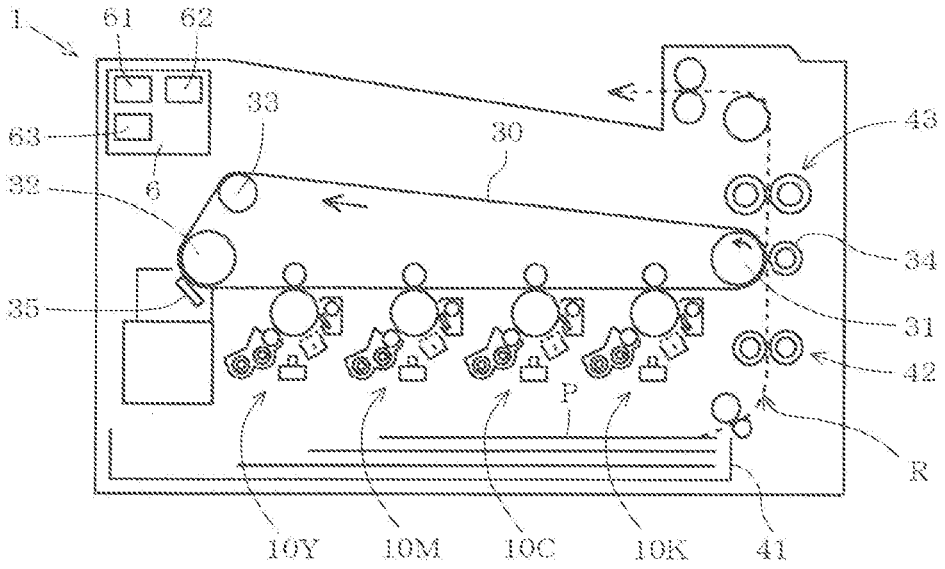
FIG. 1 A schematic view showing an example of an image forming device according to the present invention.

FIG. 1 is a schematic view of a so-called tandem-type color printer showing an example of the image forming device according to the present invention. The printer shown in this figure includes a conductive endless intermediate transfer belt 30. The intermediate transfer belt 30 is placed over rollers 31, 32 and 33. The roller 31 is coupled to an unillustrated motor, the roller 31 is rotated counterclockwise by the drive of the motor and thus the intermediate transfer belt 30 and the rollers 32 and 33 in contact therewith are driven to rotate. In the roller 33, a force acting outwardly is applied by an unillustrated force application unit to the intermediate transfer belt 30, and thus a tension is applied to the intermediate transfer belt 30. A secondary transfer roller 34 is pressed onto the outside of a belt portion supported by the roller 31. In a nip portion (secondary transfer region) between the secondary transfer roller 34 and the intermediate transfer belt 30, a toner image formed on the intermediate transfer belt 30 is transferred to a sheet P that is transported.

On the outside of a belt portion supported by the roller 32, a cleaning blade 35 that cleans the surface of the intermediate transfer belt 30 is provided. The cleaning blade 35 is pressed onto the roller 32 through the intermediate transfer belt 30, and removes and collects residual toner that has not been transferred at a portion in contact with the intermediate transfer belt 30.

Below the intermediate transfer belt 30, sequentially from the upstream side in the rotation direction of the intermediate transfer belt 30, four image formation units 10Y, 10M, 10C and 10K (hereinafter also referred collectively to as "image formation units 10") of yellow (Y), magenta (M), cyan (C) and black (K) are arranged removably with respect to a device main body 1. In these image formation units 10, the developers of individual colors are used to form the toner images of the corresponding colors.

Figure 2:
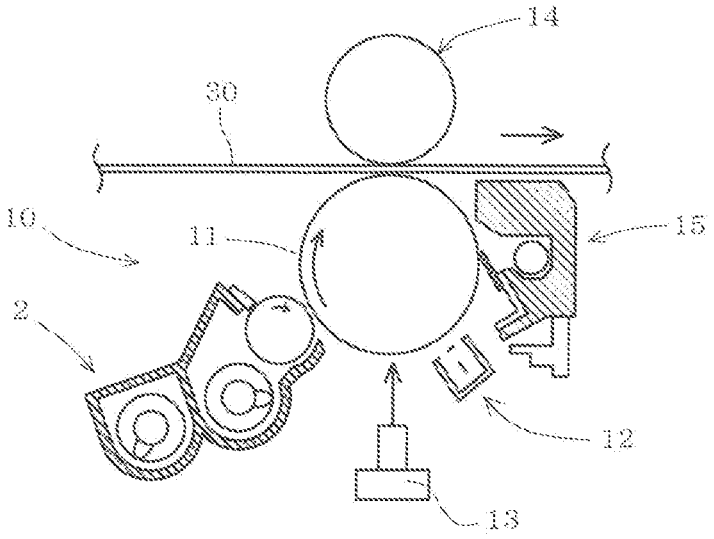
FIG. 2 A schematic view of an image formation unit.

FIG. 2 shows a schematic view of the image formation unit 10. The image formation unit 10 includes a cylindrical photosensitive member 11 as an electrostatic latent image carrying member. Around the photosensitive member 11, sequentially along its rotation direction (clockwise direction), a charging device 12, an exposure device 13, a developing device 2, a primary transfer roller 14 and a cleaning device 15 are arranged. The primary transfer roller 14 is pressed onto the photosensitive member 11 through the intermediate transfer belt 30 to form a nip portion (primary transfer region).

As shown in FIG. 1, below the image formation units 10, as a paper feed device, a paper feed cassette 41 is removably arranged. Sheets P stacked and stored in the paper feed cassette 41 are fed out one by one, sequentially from the uppermost sheet, to a transport path R by the rotation of a paper feed roller arranged in the vicinity of the paper feed cassette 41. The sheet P fed out from the paper feed cassette 41 is transported to a resist roller pair 42, where the sheet P is fed out to the secondary transfer region with predetermined timing.

The image forming device can be switched between a monochrome mode where one-color toner (for example, black) is used to form a monochrome image and a color mode where four-color toner is used to form a color image.

An example of an image formation operation in the color mode will be briefly described. First, in each of the image formation units 10, the outer circumferential surface of the photosensitive member 11 that is driven to rotate at a predetermined circumferential speed is charged by the charging device 12. Then, light corresponding to image information is applied from the exposure device 13 to the charged surface of the photosensitive member 11 to form an electrostatic latent image. Then, the electrostatic latent image is visualized by a toner that is a developer fed from the developing device 2. When the toner images of the individual colors formed on the surfaces of the photosensitive members 11 as described above reach the primary transfer region by the rotation of the photosensitive members 11, the toner images are transferred (primarily transferred) from the photosensitive members 11 onto the intermediate transfer belt 30 and are superimposed in the following order: yellow, magenta, cyan and black.

The residual toner that has not been transferred to the intermediate transfer belt 30 and that has been left on the photosensitive member 11 is scraped by the cleaning device 15 and is removed from the outer circumferential surface of the photosensitive member 11.

The toner image of the four colors is transported by the intermediate transfer belt 30 to the secondary transfer region. On the other hand, with timing corresponding to the transport, the sheet P is transported from the resist roller pair 42 to the secondary transfer region. Then, the toner image of the four colors is transferred (secondarily transferred) in the secondary transfer region from the intermediate transfer belt 30 to the sheet P. The sheet P to which the toner image of the four colors has been transferred is transported to a fixing roller pair 43. In the fixing roller pair 43, the sheet P is passed through a nip portion between a fixing roller and a pressure roller. In the meantime, the sheet P is heated and pressurized, and thus the toner image on the sheet P is fused and fixed. The sheet P to the toner image has been fixed is ejected into a paper ejection tray by an ejection roller pair.

On the other hand, the residual toner that has not been transferred to the sheet P and that has been left on the intermediate transfer belt 30 is scraped by the cleaning blade 35 and is removed from the outer circumferential surface of the intermediate transfer belt 30. Thereafter, the driven rotation of the photosensitive members 11 and the intermediate transfer belt 30 is stopped.

Figure 3:
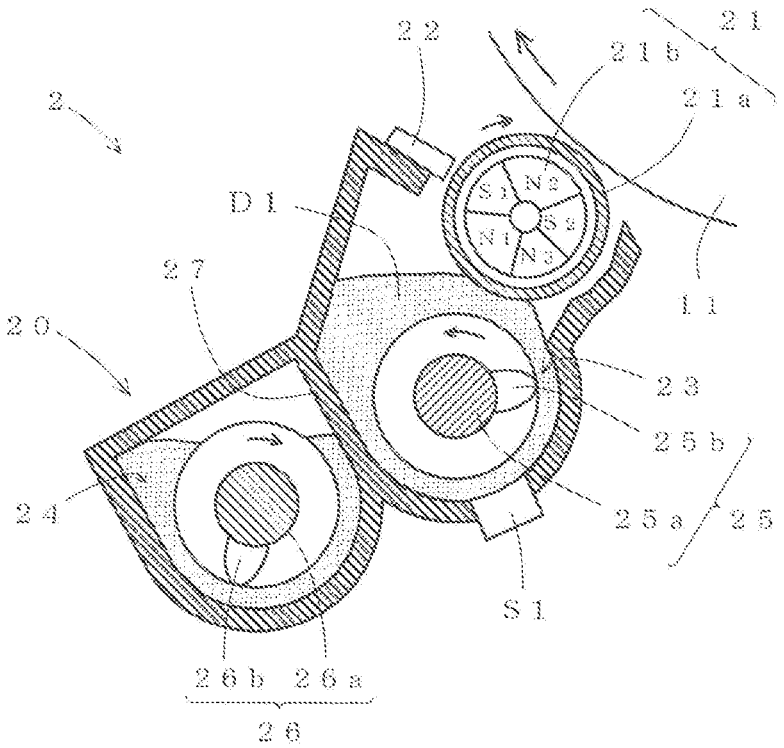
FIG. 3 A vertical cross-sectional view of a developing device.
Figure 4:
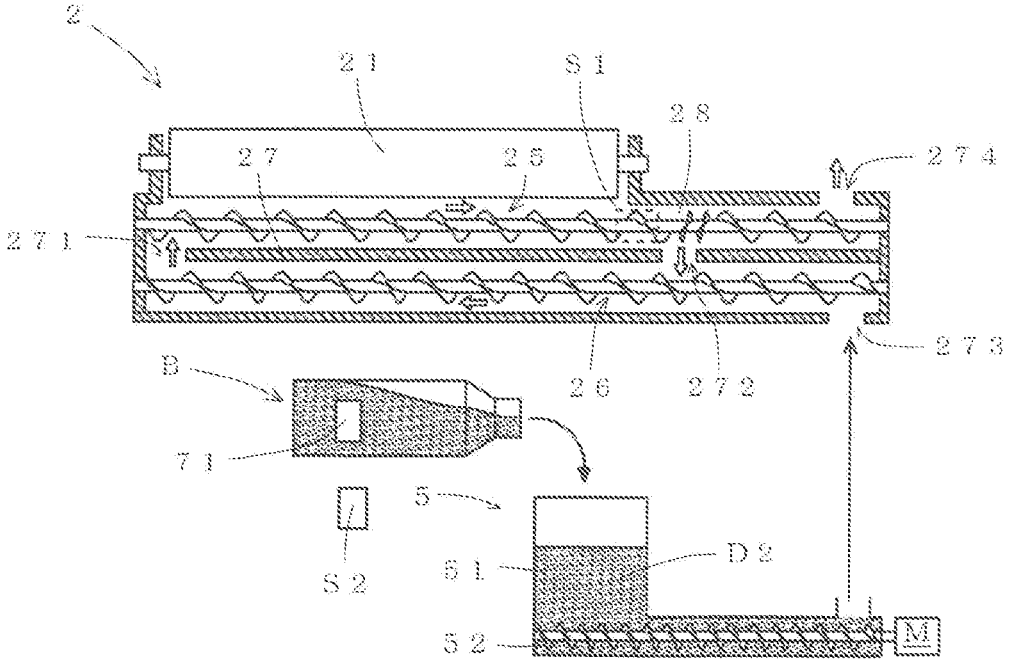
FIG. 4 A horizontal cross-sectional view of the developing device.

FIGS. 3 and 4 respectively show schematic diagrams of a vertical cross-sectional view and a horizontal cross-sectional view of the developing device 2. The developing device 2 shown in these figures includes a developing unit 20, a developer hopper 5 (shown in FIG. 4) and a developer bottle B (shown in FIG. 4), and uses a two-component developer D1 containing a first carrier formed of magnetic particles and a toner to develop the electrostatic latent image on the photosensitive member 11. The developing unit 20 includes a freely rotating development roller 21, a plate-shaped restriction member 22 that restricts the amount of developer transported to a development portion, a first transport path 23 that is formed along the development roller 21, a second transport path 24 that is formed parallel to the first transport path 23 through a partition plate 27 and a first transport screw 25 and a second transport screw 26 that are arranged in the first transport path 23 and the second transport path 24. At both end portions of the partition plate 27 in the longitudinal direction, a first communication port 271 and a second communication port 272 (shown in FIG. 4) are formed, and the first transport path 23 and the second transport path 24 communicate with each other at both ends in the longitudinal direction. At an upstream end of the second transport path 24 in a developer transport direction, a supply opening 273 for supplying a supply developer D2 from the developer hopper 5 to the developing unit 20 is formed. At a downstream end of the first transport path 23 in the developer transport direction, a discharge port 274 for discharging the developer D1 within the developing unit 20 is formed. In the bottom surface of the first transport path 23, a permeability sensor (toner concentration detection unit) S1 for detecting the toner concentration of the developer D1 is provided. The supply developer D2 is sequentially supplied from the developer bottle B to the developer hopper 5, and when the developer bottle B becomes empty, the empty developer bottle B is removed from the device main body 1, and a new developer bottle B is fitted.

The development roller 21 includes a cylindrical member 21*a* that is rotated clockwise in FIG. 3 with an unillustrated drive mechanism and a magnetic field generation unit 21*b* that is formed with a plurality of magnetic poles provided within the cylindrical member 21*a*. The magnetic poles of the magnetic field generation unit 21*b* individually function as follows. The magnetic pole (drawing pole) $N_1$ functions to draw the developer D1 up to the cylindrical member 21*a*. The magnetic pole $S_1$ functions to control the amount of developer D1 transported to the development portion together with the restriction member 22. The magnetic pole $N_2$ functions to make the developer D1 ear up in the shape of a brush to develop, with the toner, the electrostatic latent image on the surface of the photosensitive member 11. The magnetic pole $S_2$ functions to transport the developer D1 into the developing device. The magnetic pole $N_3$ functions to transport the developer D1 into the developing unit 20 and to separate the developer D1 from the cylindrical member 21*a* with a repulsive magnetic field generated with the adjacent magnetic pole $N_1$ to return it to an agitation portion of the first transport screw 25.

In the first transport screw 25 and the second transport screw 26, helical blades 25*b* and 26*b* are provided on the outer circumference of axial members 25*a* and 26*a*, and slightly on the downstream side of the first transport screw 25 in the developer transport direction with respect to the second communication port 272, a backflow generation portion 28 in which the direction where the blade is inclined is opposite is provided. The first transport screw 25 and the second transport screw 26 are rotated by an unillustrated drive mechanism in directions opposite to each other.

As shown in FIG. 4, the developer hopper 5 is connected to the developing unit 20. The supply developer D2 containing a second carrier and the toner is fed from the developer bottle B to the developer hopper 5. When the developer bottle B is fitted to the device main body 1, the properties of the second carrier, which will be described later, are read with a reading unit S2 from an IC chip (recording member) 71 attached to the developer bottle B, are sent to a control portion 6 and are stored in a second storage unit 62. The developer hopper 5 includes a storage portion 51 that stores the supply developer D2 and a supply screw 52 that supplies the supply developer D2. The supply screw 52 is rotated by a developer feed motor M, and the number of revolutions can be changed. By controlling the number of revolutions of the developer feed motor M, the amount of supply developer D2 supplied to the developing unit 20 is adjusted.

When the toner is consumed by the development, and the toner concentration within the developing unit 20 is lowered, the detection value of the permeability sensor S1 becomes lower than a setting value, and the supply developer D2 is supplied from the developer hopper 5 to the developing unit 20. When the toner concentration is high, and the detection value of the permeability sensor S1 is higher than the setting value, the supply developer D2 is prevented from being supplied. It is assumed that as the toner concentration within the developer becomes lower, the detection value of the permeability sensor S1 used here is decreased.

The supply developer D2 supplied from the developer hopper 5 is received within the developing unit 20 through the supply opening 273 formed at the upstream end of the second transport path 24 in the developer transport direction. As long as the position in which the supply opening 273 is formed is on the second transport path 24, it is not particularly limited; in order to sufficiently agitate and mix the supply developer D2 during the supply to the development roller 21, it is preferable to form the supply opening 273 at the upstream end of the second transport path 24 in the developer transport direction. The developer D2 supplied from the supply opening 273 to the developing unit 20 is transported by the rotation of the second transport screw 26 in the leftward direction of the figure together with the developer D1 while being agitated, thereafter is passed through the first communication port 271 and is transported to the first transport path 23. In the first transport path 23, the developers D1 and D2 are transported by the rotation of the first transport screw 25 in the rightward direction of the figure while being agitated. Then, since in the backflow generation portion 28, the developers D1 and D2 are prevented from being transported in the rightward direction of the figure, they are passed through the second communication port 272 and are transported again to the second transport path 24. In this way, the developers D1 and D2 are circulated and agitated within a circulation path formed with the first transport path 23 and the second transport path 24.

As the second carrier is supplied together with the supply of the toner, and thus the amount of developer within the developing unit 20 is increased, the amount of developers D1 and D2 left in the backflow generation portion 28 is increased, and part of the developers D1 and D2 passes over the backflow generation portion 28. Then, the developers D1 and D2 that have passed over the backflow generation portion 28 are transported in the rightward direction of FIG. 4, and is discharged through the discharge port 274 to the outside of the developing unit 20. As described above, while the supply developer D2 is being supplied from the developer hopper 5 to the developing unit 20, the developer degraded by the use is discharged from the developing unit 20, and thus the generation of image failures such as fogging and scattered character caused by the degradation of the developer is reduced.

Hence, in the developing device of the present invention, as the second carrier within the developer hopper 5, a second carrier whose bulk density is lower than that of the first carrier is used. Thus, it is possible to reduce the weight of the supply developer D2. The bulk density of the second carrier is preferably 0.6 to 0.95 times that of the second carrier.

However, when the bulk density is different between the second carrier of the supply developer D2 and the first carrier of the developer D1, even if the detection value of the permeability sensor S1 (wt %) is the same, the toner concentration within the developing unit 20 is varied depending on the presence proportion of the second carrier within the developing unit 20.

Figure 5:
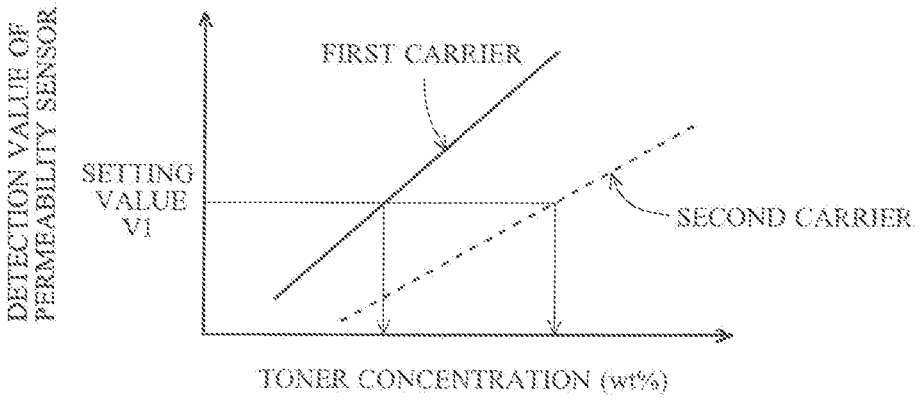
FIG. 5 A graph showing a correlation between the detection value of a permeability sensor and a toner concentration in a first carrier and a second carrier.

FIG. 5 is a diagram showing variations in the detection value of the permeability sensor for the toner concentration in the first carrier (bulk density: 1.7 g/cm$^3$) and the second carrier (bulk density: 1.45 g/cm$^3$) with the detection value of the permeability sensor on the vertical axis and the toner concentration on the horizontal axis. Since variations in the detection value of the permeability sensor with respect to variations in the toner concentration are greater in the first carrier than in the second carrier, even if the setting value of the permeability sensor is the same, the toner concentration is higher when the first carrier is used than that when the second carrier is used.

Figure 6:
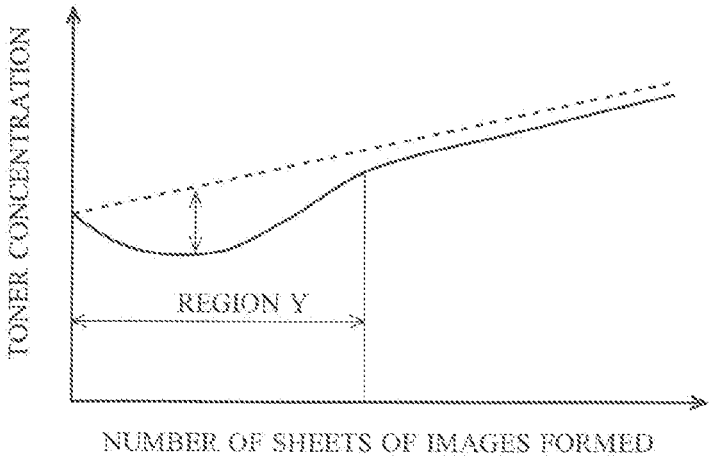
FIG. 6 A diagram showing variations in toner concentration for the number of sheets of images formed.

Hence, when image formation is performed without the setting value of the permeability sensor being corrected, as the number of sheets of images formed is increased, the second carrier within the developing unit 20 is supplied, the toner concentration within the developing unit 20 is gradually increased as shown in FIG. 6. The toner concentration is temporarily decreased in a region Y where the number of sheets of images formed in FIG. 6 is several tens of thousands or less. This is because: secular degradation or the like does not occur on the carrier, and since the capability of providing charge is satisfactory, the toner charge amount is increased and thus the bulk density of the developer is decreased, the toner concentration is determined to be high, and thus the toner (developer) is not supplied. Thereafter, when the number of sheets of images formed is increased, secular degradation on the carrier develops, and thus the control on toner concentration is stabilized.

Hence, in the present invention, based on the presence proportion of the second carrier within the developing unit calculated by a calculation unit, a correlation between the detection value of the permeability sensor and the toner concentration in the first carrier and the second carrier stored in a first storage unit 61 and a second storage unit 62 is used, and thus a correlation between the detection value of the permeability sensor and the toner concentration in the carrier (mixture of the first carrier and the second carrier) within the developing unit is determined, with the result that the setting value of the permeability sensor is corrected.

Figure 7:
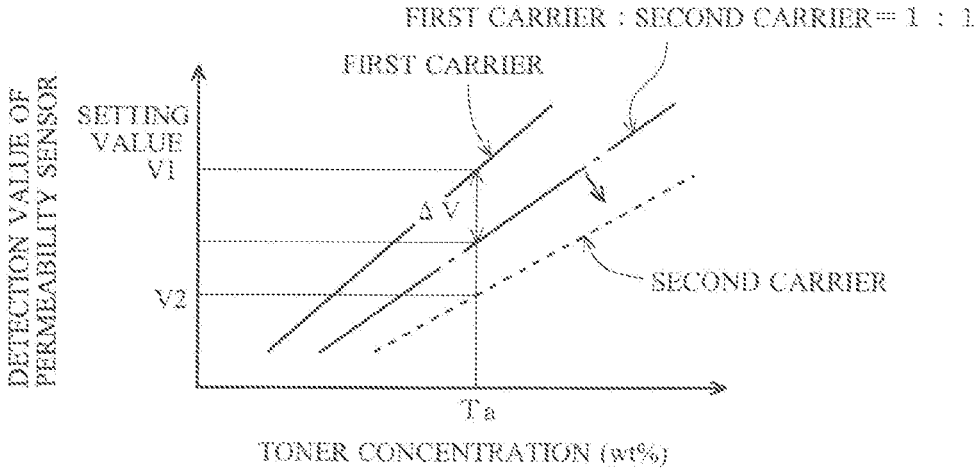
FIG. 7 A graph showing a correlation between the detection value of the permeability sensor and the toner concentration in the first carrier, the second carrier and a carrier obtained by mixing them.
Figure 8:
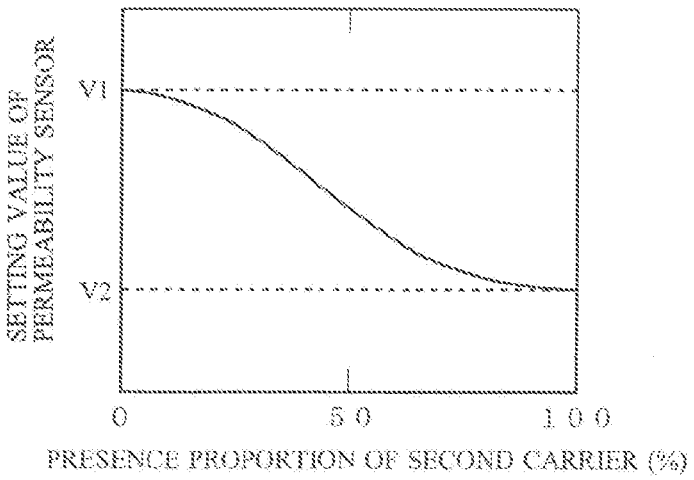
FIG. 8 A diagram showing a relationship between variations in the presence proportion of the second carrier within a developing unit and the setting value of the permeability sensor.

Specifically, as shown in FIG. 7, when the correlation between the detection value of the permeability sensor S1 and the toner concentration in the first carrier is represented by a solid line, and the correlation between the detection value of the permeability sensor S1 and the toner concentration in the second carrier is represented by a broken line, the correlation between the detection value of the permeability sensor S1 and the toner concentration in the carrier within the developing unit 20 is present between the solid line and the broken line and is determined by the presence proportion of the second carrier in the carrier within the developing unit 20. For example, when the presence proportion of the second carrier in the carrier within the developing unit 20 is 50%, a correlation represented by an alternate long and short dash line in FIG. 7 holds true. In this case, in order to keep the toner concentration within the developing unit 20 at Ta, it is necessary to decrease the setting value of permeability sensor S1 by ΔV from a setting value "V1" when only the first carrier within the developing unit 20 is present. As the presence proportion of the second carrier in the carrier within the developing unit 20 is increased, ΔV is increased. FIG. 8 shows an example of variations in the setting value of the permeability sensor S1 for the presence proportion of the second carrier within the developing unit 20.

Figure 9:
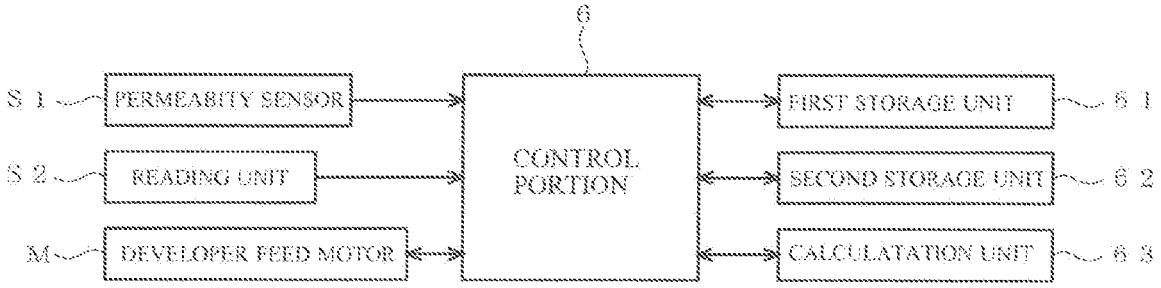
FIG. 9 A block diagram showing an example of the configuration of the image forming device according to the present invention.

FIG. 9 is a block diagram showing an example of the configuration of the image forming device according to the present invention. Before the second carrier is fed, a correlation between the amount of first carrier stored in the developing unit 20, the detection value of the permeability sensor S1 for the first carrier and the toner concentration is stored in the first storage unit 61. When the developer bottle B is fitted to the device main body 1, a correlation between the detection value of the permeability sensor S1 for the second carrier and the toner concentration is read by the reading unit S2 from the IC chip (storage member) 71 attached to the developer bottle B, is sent to the control portion 6 and is stored in the second storage unit 62. The amount of supplied second carrier calculated from the rotation time of the developer feed motor M or the number of sheets of images formed is also stored in the second storage unit 62. A calculation unit 63 calculates the presence proportion of the second carrier from the amount of first carrier stored in the developing unit 20 before the feeding of the second carrier, which is stored in the first storage unit 61 and the amount of supplied second carrier stored in the second storage unit 62. Then, based on the calculated presence proportion of the second carrier, a correlation between the detection value of the permeability sensor S1 and the toner concentration in the carrier within the developing unit 20 is determined, and the setting value of the permeability sensor S1 is corrected such that the toner concentration within the developing unit 20 becomes a predetermined value. The detection value is sent to the control portion 6 from the permeability sensor S1, and rotation control on the developer feed motor M is performed such that the detection value of the permeability sensor S1 becomes the corrected setting value.

Preferably, for example, in terms of reducing a temporary decrease in the toner concentration in the region where the number of sheets of images formed is several tens of thousands or less as shown in FIG. 6 and thereby more effectively preventing image noises such as fogging and uneven density, with consideration given to the number of sheets of images formed, environmental changes such as humidity, a print coverage in image formation and the like, the setting value of the permeability sensor S1 is further corrected. A correction table for the number of sheets of images formed, a correction table for humidity and a correction table for the print coverage in the setting value of the permeability sensor S1 are shown in tables 1 to 3, respectively.

TABLE 1

| | | Rate of A carrier | | | | | | | |
|---|---|---|---|---|---|---|---|---|---|
| | | 100 | 90 | 80 | 70 | 60 | 40 | 20 | 0 |
| Number of sheets of images formed [×1000 sheets] | ~0.5 | 0 | 0 | 0 | 0 | 0 | 0 | 0 | 0 |
| | 1 | −51 | −45 | −39 | −35 | −33 | −31 | −27 | −25 |
| | 2 | −68 | −60 | −52 | −46 | −44 | −41 | −37 | −34 |
| | 3 | −76 | −68 | −58 | −52 | −50 | −46 | −41 | −38 |
| | 5 | −92 | −82 | −70 | −63 | −61 | −56 | −50 | −46 |
| | 7 | −109 | −97 | −83 | −75 | −72 | −66 | −59 | −54 |
| | 10 | −106 | −94 | −81 | −72 | −70 | −64 | −57 | −53 |
| | 15 | −101 | −90 | −77 | −69 | −66 | −61 | −54 | −50 |
| | 20 | −89 | −79 | −68 | −61 | −58 | −53 | −48 | −44 |
| | 25 | −76 | −68 | −59 | −52 | −50 | −46 | −41 | −38 |
| | 30 | −60 | −54 | −46 | −41 | −40 | −36 | −32 | −30 |
| | 35 | −30 | −27 | −23 | −21 | −20 | −18 | −16 | −15 |
| | 80 | 0 | −3 | −7 | −10 | −10 | −12 | −14 | −15 |
| | 85 | 0 | −3 | −7 | −10 | −10 | −12 | −14 | −15 |
| | 90 | 0 | −3 | −7 | −10 | −10 | −12 | −14 | −15 |
| | 95 | 0 | −3 | −7 | −10 | −10 | −12 | −14 | −15 |
| | 100 | 0 | −3 | −7 | −10 | −10 | −12 | −14 | −15 |
| | 150 | 0 | −3 | −7 | −10 | −10 | −12 | −14 | −15 |
| | 200 | 0 | −3 | −7 | −10 | −10 | −12 | −14 | −15 |
| | 250~ | 0 | −3 | −7 | −10 | −10 | −12 | −14 | −15 |

[% × 100]

TABLE 2

| | Absplute humidity g/m$^3$ | | | | | | | | | | | | | | | | |
|---|---|---|---|---|---|---|---|---|---|---|---|---|---|---|---|---|---|
| | 0 ~1 | ~2 | ~3 | ~4 | ~5 | ~6 | ~7 | ~8 | ~9 | ~10 | ~11 | ~12 | ~13 | ~14 | ~15 | ~16 | ~17 |
| Amount of correction | −30 | −30 | −24 | −19 | −15 | −12 | −10 | −8 | −6 | 0 | 0 | 0 | 0 | 0 | 3 | 7 | 10 |

| | Absplute humidity g/m$^3$ | | | | | | |
|---|---|---|---|---|---|---|---|
| | ~18 | ~19 | ~20 | ~21 | ~22 | ~23 | 24~ |
| Amount of correction | 13 | 17 | 20 | 23 | 27 | 30 | 30 |

[% × 100]

The correction table shown in table 1 is used for determining the amount of correction of the setting value of the permeability sensor S1 from the presence proportion of the first carrier within the developing unit 20 and the number of sheets of images formed. In the region where the number of sheets of images formed is several tens of thousands or less, since the first carrier is not degraded and has a high capability of providing charge, the setting value of the permeability sensor S1 is corrected to be decreased.

The correction table shown in table 2 is used for determining the amount of correction of the setting value of the permeability sensor S1 from absolute humidity. When the absolute humidity is lower than a predetermined value, since the toner charge amount is increased, the setting value of the permeability sensor S1 is corrected to be decreased. On the other hand, when the absolute humidity is higher than the predetermined value, since the toner charge amount is decreased, the setting value of the permeability sensor S1 is corrected to be increased.

The correction table shown in table 3 is used for determining the amount of correction of the setting value of the permeability sensor S1 from the print coverage in image formation. When the print coverage is low, since the amount of toner consumed is low, and the toner charge amount is increased, the setting value of the permeability sensor S1 is corrected to be decreased.

TABLE 3

| | Print coverage (%) | | | | | |
|---|---|---|---|---|---|---|
| | 0~1 | ~3 | ~5 | ~10 | ~20 | 20~ |
| Amount of correction | −40 | −20 | 0 | 0 | 0 | 0 |

[% × 100]

Although in the embodiment described above, the second carrier is supplied to the developing unit 20 in which the first carrier is stored, in practical use, for example, it is possible that a B carrier is supplied to the developing unit 20 in which an A carrier is stored, and thereafter the A carrier is further supplied. Hence, a description will be given of a method of calculating a presence proportion $R_{NEW}$ of the B carrier within the developing unit 20 in such a case. If the presence proportion $R_{NEW}$ of the B carrier within the developing unit 20 is determined, a method of correcting the setting value of the permeability sensor S1 based on the presence proportion $R_{NEW}$ of the B carrier is the same as in the embodiment described previously.

When it is assumed that at least one of the A carrier and the B carrier is supplied as the second carrier into the developing unit in which the A carrier and the B carrier are stored as the first carrier in predetermined proportions, a presence proportion $R_{NEW}$ of the B carrier within the developing unit is calculated from formulas (1) to (3) below:

(i) When $M_{C0}+M_{CA}+M_{CB}: M_F$, $R_{NEW}=M_{CB}/(M_{C0}+M_{CA}+M_{CB})$ (1)

(ii) When $M_{C0}+M_{CA}+M_{CB}:>M_F$ and the $A$ carrier is supplied, $R_{NEW}=(M_{FB}\times R_d)/(M_f+M_{C1})$ (2)

(iii) When $M_{C0}+M_{CA}+M_{CB}:>M_F$ and the $B$ carrier is supplied, $R_{NEW}=(M_{FB}\times R_d+M_{C1})/(M_f+M_{C1})$ (3)

where $M_F$: carrier discharge start weight $(M_{FA}\times(1-R_d)+M_{FB}\times R_d)$ $M_{C0}$: carrier weight at time of start, $M_{FA}$: discharge start carrier weight with only the A carrier, $M_{FB}$: discharge start carrier weight with only the B carrier, $R_d$: proportion of the B carrier within the developing unit before supply of the developer, $M_{CA}$: accumulated supply amount of the A carrier, $M_{CB}$: accumulated supply amount of the B carrier and $M_{C1}$: carrier weight within the developer supplied.

Figure 10:
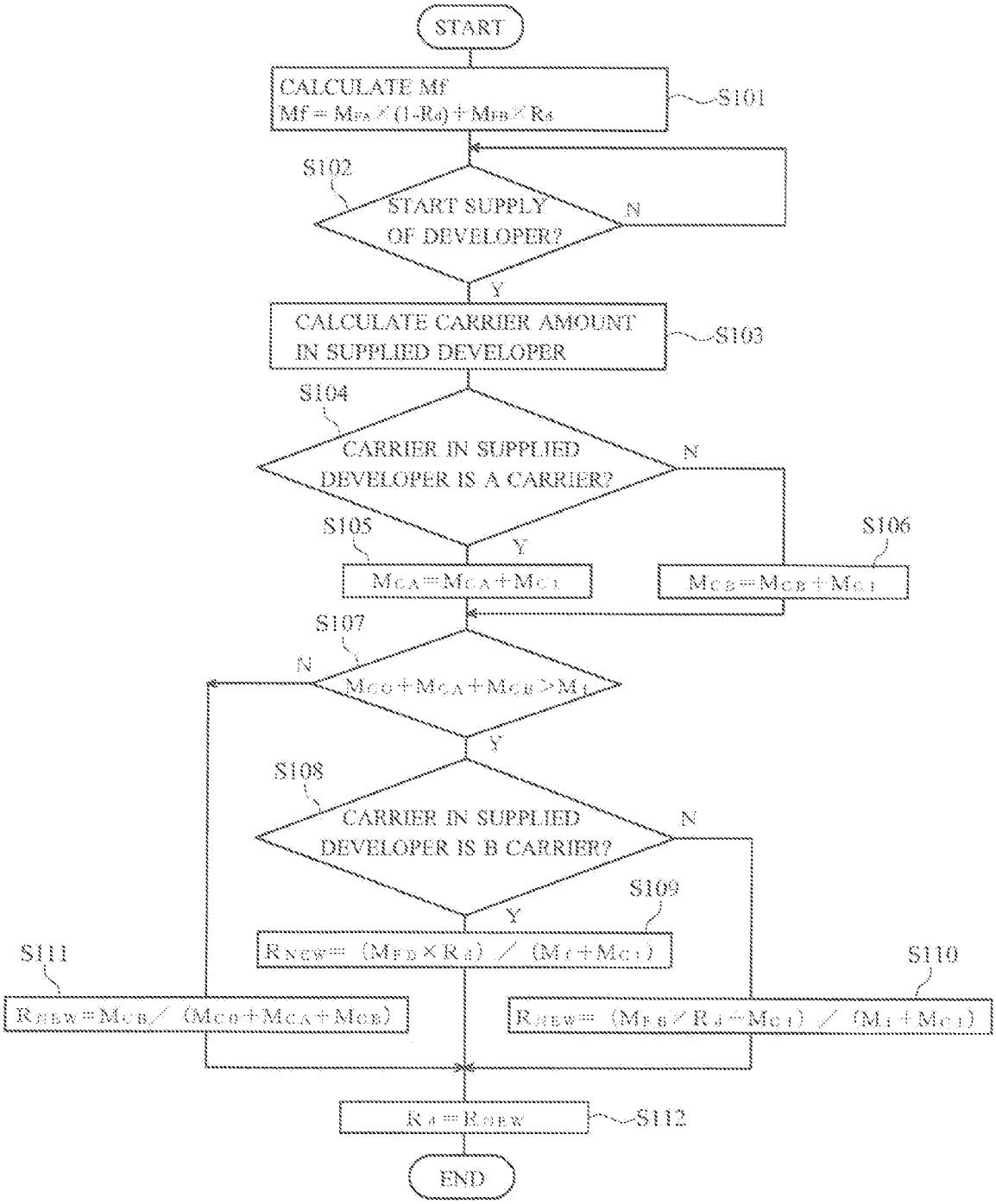
FIG. 10 A flowchart determining the presence proportion of a B carrier within the developing unit.

FIG. 10 shows a flowchart that determines the presence proportion $R_{NEW}$ of the B carrier within the developing unit 20. A weight $M_F$ at the start of discharge of the carrier from the developing unit 20 is first calculated (step 101). Then, when the supply of the developer to the developing unit 20 is started (step S102), the carrier weight in the supplied developer is calculated (step S103). Then, whether or not the carrier in the supplied developer is the A carrier is determined (step S104), and when the A carrier is supplied, the carrier weight in the supplied developer is added to the accumulated supply amount of A carrier (step S105). On the other hand, when the B carrier is supplied, the carrier weight in the supplied developer is added to the accumulated supply amount of B carrier (step S106).

Then, whether or not the total carrier weight $(M_{C0}+M_{CA}+M_{CB})$ within the developing unit 20 is more than the carrier discharge start weight $M_F$ is determined (step S107). Then, when the total carrier weight within the developing unit 20 is less than the carrier discharge start weight $M_F$, the presence proportion $R_{NEW}$ of the B carrier within the developing unit 20 is calculated from formula (1) above (step S111). On the other hand, when the total carrier weight within the developing unit 20 is more than the carrier discharge start weight $M_F$ (step S107), whether or not the carrier in the supplied developer is the A carrier is determined (step S108). Then, when the carrier in the supplied developer is the A carrier, the presence proportion $R_{NEW}$ of the B carrier within the developing unit 20 is calculated from formula (2) above (step S109) whereas when the carrier in the supplied developer is the B carrier, the presence proportion $R_{NEW}$ of the B carrier within the developing unit 20 is calculated from formula (3) above (step S110). Thereafter, the calculated $R_{NEW}$ is stored as the proportion $R_d$ of the B carrier within the developing unit before the supply of the developer (step 112).

What is claimed is:

1. An image forming device that comprises:

a developing device which includes a developing unit storing a developer containing a first carrier and a toner and a toner concentration detection unit detecting a toner concentration within the developing unit;

a supply container which stores a supply developer containing a second carrier whose bulk density is different from a bulk density of the first carrier and the toner, to which a recording member recording a property of the second carrier is attached and which is removable with respect to a device main body, and that supplies, when a detection value detected by the toner concentration detection unit is lower than a setting value of the toner concentration detection unit, the supply developer from the supply container to the developing unit to increase the amount of the developer in the developing unit, and when the increase causes an excessive amount of the developer within the developing unit, the excessive amount is discharged from the developing unit, the image forming device further comprising:

a first storage unit which stores a storage amount of the first carrier stored in the developing unit before feeding of the second carrier and a property of the first carrier;

a reading unit which reads the property of the second carrier from the recording member;

a second storage unit which stores the property of the second carrier read by the reading unit and a supply amount of the second carrier supplied from the supply container to the developing unit; and a calculation unit which calculates a presence proportion of the second carrier within the developing unit from the storage amount of the first carrier stored in the developing unit before feeding of the second carrier and the supply amount of the second carrier supplied from the supply container to the developing unit, wherein the setting value of the toner concentration detection unit is corrected based on the presence proportion of the second carrier detected by the calculation unit.

2. The image forming device of claim 1, wherein when at least one of an A carrier and a B carrier is supplied as the second carrier into the developing unit in which the A carrier and the B carrier are stored as the first carrier in predetermined proportions, a presence proportion $R_{NEW}$ of the B carrier within the developing unit is calculated from formulas (1) to (3) below:

(i) When $M_{C0}+M_{CA}+M_{CB}:M_F$, $R_{NEW}=M_{CB}/(M_{C0}+M_{CA}+M_{CB})$ (1)

(ii) When $M_{C0}+M_{CA}+M_{CB}:\leq M_F$ and the $A$ carrier is supplied, $R_{NEW}=(M_{FB}\times R_d)/(M_f+M_{C1})$ (2)

(iii) When $M_{C0}+M_{CA}+M_{CB}:>M_F$ and the $B$ carrier is supplied, $R_{NEW}=(M_{FB}\times R_d+M_{C1})/(M_f+M_{C1})$ (3)

where $M_F$: carrier discharge start weight $(M_{FA}\times(1-R_d)+M_{FB}\times R_d)$ $M_{C0}$: carrier weight at time of start, $M_{FA}$: discharge start carrier weight with only the A carrier, $M_{FB}$: discharge start carrier weight with only the B carrier, $R_d$: proportion of the B carrier within the developing unit before supply of the developer, $M_{CA}$: accumulated supply amount of the A carrier, $M_{CB}$: accumulated supply amount of the B carrier and $M_{C1}$: carrier weight within the developer supplied.

3. The image forming device of claim 1, wherein the bulk density of the second carrier is 0.6 to 0.95 times the bulk density of the first carrier.

4. The image forming device of claim 1, wherein the setting value of the toner concentration detection unit is further corrected based on at least one piece of information of a number of sheets of images formed, an operating environment and an image print coverage.

5. The image forming device of claim 1, wherein the properties of the first carrier and the second carrier are a correlation between the detection value of the toner concentration detection unit and the toner concentration.

6. The image forming device of claim 1, wherein the development device includes a development roller, a transport path along the development roller, and a transport screw arranged in the transport path with a first portion having helical blades inclined in a first direction to transport the developer in the transport path and a backflow generation portion at a downstream side of the transport path having backflow blades inclined in an opposite direction to the first direction.

7. The image forming device of claim 6, wherein the excessive developer is discharged from a discharge port arranged in an area of the backflow generation portion of the transport screw.

* * * * *